US011536099B2

(12) United States Patent
Sredensek

(10) Patent No.: US 11,536,099 B2
(45) Date of Patent: Dec. 27, 2022

(54) MODULAR BOOST SYSTEM FOR A JACK

(71) Applicant: Halliburton Energy Services, Inc., Houston, TX (US)

(72) Inventor: Herwig Michael Sredensek, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 292 days.

(21) Appl. No.: 16/770,157

(22) PCT Filed: Jan. 16, 2018

(86) PCT No.: PCT/US2018/013829

§ 371 (c)(1),
(2) Date: Jun. 5, 2020

(87) PCT Pub. No.: WO2019/143317

PCT Pub. Date: Jul. 25, 2019

(65) Prior Publication Data

US 2020/0386062 A1 Dec. 10, 2020

(51) Int. Cl.

| | |
|---|---|
| ***E21B 19/086*** | (2006.01) |
| ***B66F 3/24*** | (2006.01) |
| *E21B 19/02* | (2006.01) |
| *E21B 19/16* | (2006.01) |

(52) U.S. Cl.

CPC ..... *E21B 19/086* (2013.01); *B66F 3/24* (2013.01); *B66F 2700/05* (2013.01); *E21B 19/02* (2013.01); *E21B 19/16* (2013.01)

(58) Field of Classification Search

CPC ..... E21B 19/086; B66F 3/24; B66F 2700/05
See application file for complete search history.

(56) References Cited

U.S. PATENT DOCUMENTS 3,722,603 A * 3/1973 Brown ..... E21B 19/16 173/159
4,085,796 A * 4/1978 Council ..... E21B 19/20 173/149
4,405,115 A * 9/1983 Boyadjieff ..... E02B 17/0854 254/106
4,421,175 A * 12/1983 Boyadjieff ..... E21B 3/04 166/383

(Continued)

OTHER PUBLICATIONS

International Application No. PCT/US2018/013829, "International Search Report and Written Opinion", dated Oct. 12, 2018, 12 pages.

*Primary Examiner* — Shane Bomar
(74) *Attorney, Agent, or Firm* — Kilpatrick Townsend & Stockton LLP

(57) ABSTRACT

A modular boost system can be added to a jack to enable greater lift capacity of the jack. One example can involve a jack that is positionable at a well surface for moving a tubing string through a wellbore in a subterranean formation. The jack can include a frame and an adjustable plate that is alternately (i) attachable at a stationary location in the frame for fixing the adjustable plate at the stationary location or (ii) detachable from the stationary location in the frame to enable the adjustable plate to vertically move within the frame. A boost cylinder can be removably coupled to the adjustable plate and a base for selectively supplying an additional lift capability to the jack.

18 Claims, 9 Drawing Sheets

(56) References Cited

U.S. PATENT DOCUMENTS

| | | | | |
|---|---|---|---|---|
| 4,476,936 | A * | 10/1984 | Boyadjieff | E21B 33/03 166/383 |
| 6,688,393 | B2 * | 2/2004 | Sredensek | E21B 19/086 166/380 |
| 11,047,199 | B2 * | 6/2021 | Sredensek | E21B 19/004 |
| 2004/0262015 | A1 | 12/2004 | Mazzella et al. | |
| 2014/0174718 | A1 | 6/2014 | Tucken | |
| 2014/0224499 | A1 | 8/2014 | Sanders et al. | |
| 2017/0211340 | A1 | 7/2017 | Alford | |
| 2017/0234079 | A1 | 8/2017 | Price et al. | |

* cited by examiner

MODULAR BOOST SYSTEM FOR A JACK

TECHNICAL FIELD

The present disclosure relates generally to control systems for well tools. More specifically, but not by way of limitation, this disclosure relates to a modular boost system for a jack.

BACKGROUND

A well system can include a wellbore drilled into a subterranean formation for extracting fluid (e.g., oil or gas) from the subterranean formation. A well tool can be positioned in the wellbore to perform one or more functions in the wellbore, such as to measure various characteristics of the wellbore or extract hydrocarbons from the subterranean formation. A jack can be connected to the well tool at the well surface for applying a pushing force or a pulling force (or a "lifting" force) to the well tool to move the well tool downhole or uphole, respectively. And, if the well tool becomes stuck in the wellbore, the jack can apply a force to the well tool to help dislodge the well tool.

DETAILED DESCRIPTION

Figure 1:
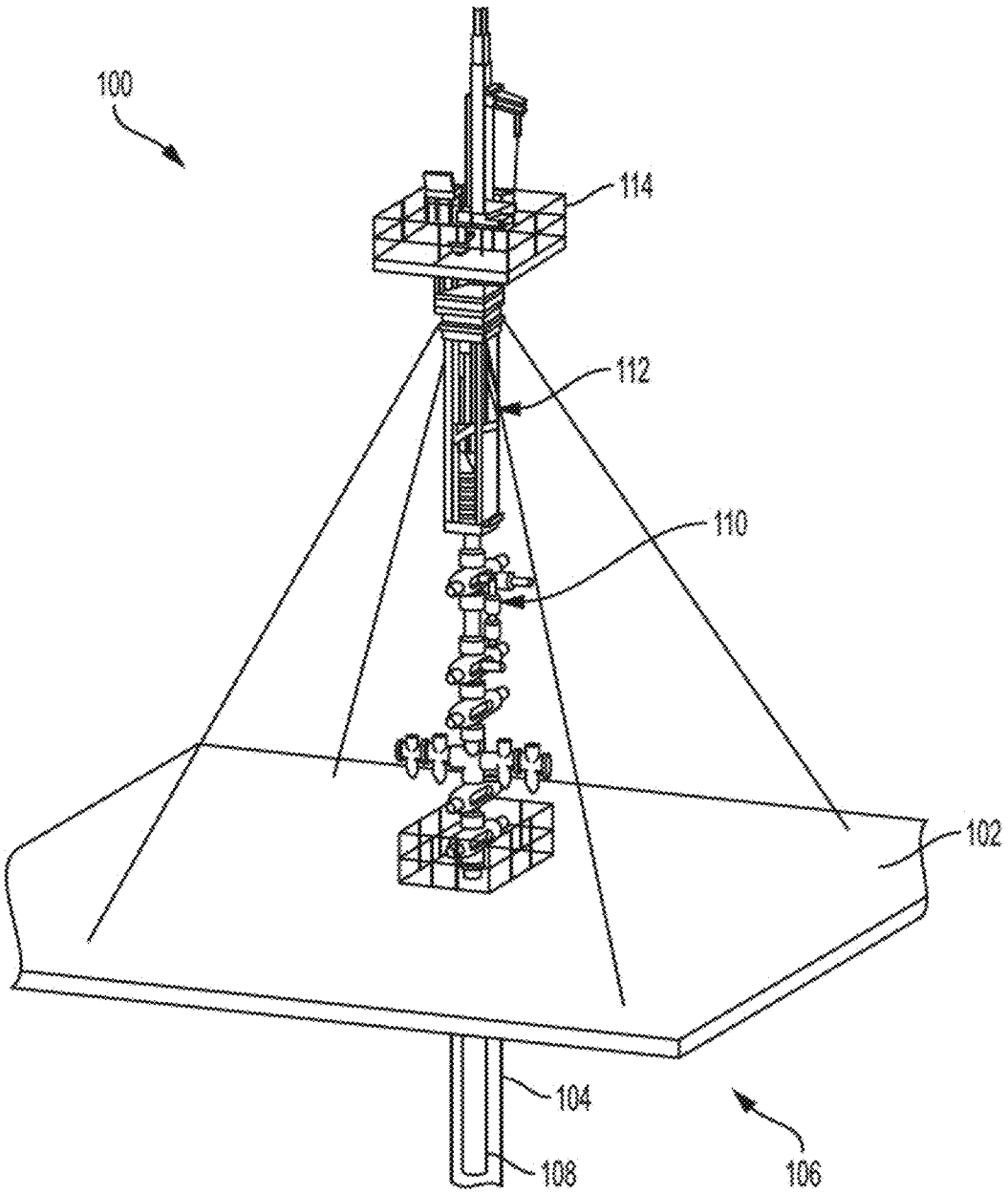
FIG. 1 is a perspective view of an example of a well system according to some aspects.

Certain aspects and features of the present disclosure related to a modular boost system capable of being selectively added to or removed from a jack, such as a hydraulic workover jack. The jack can be positioned at a well site for moving (e.g., pushing or pulling) a tubing string through a wellbore in a subterranean formation. The jack can have built-in hydraulic cylinders for applying a force to a movable plate to which the tubing string can be attached, thereby moving the tubing string through the wellbore. The hydraulic cylinders can be at least partially enclosed in a frame supported by a base plate. An adjustable plate can be positioned between the base plate and the movable plate. The adjustable plate can be fixed at a stationary location in the frame, or detached from the stationary location in the frame to enable the adjustable plate to vertically move within the frame. In some cases, the tubing string may become stuck in the wellbore during well operations. And the jack's built-in hydraulic cylinders may have insufficient lift capabilities to dislodge the well string. So, a modular boost system can be selectively added to the jack to provide additional lift capabilities to the jack. The additional lift capabilities can help free the lodged well string. After the well string is freed, the modular boost system can be removed from the jack and, for example, added to another jack as needed.

More specifically, in some examples, the modular boost system can include at least one boost cylinder. The boost cylinder(s) can be added to the jack by removably coupling the boost cylinder(s) between the adjustable plate and the base plate of the jack. The adjustable plate can then be detached from the stationary location in the frame to enable the adjustable plate to vertically move. To operate the modular boost system, the tubing string can be attached to the adjustable plate via a coupling element, such as a slip bowl. The boost cylinder(s) can then be actuated via an actuation system to supply, for example, a substantially continuous lift force to the tubing string until the boost cylinder(s) are fully extended. Then, the built-in hydraulic cylinders of the jack can be actuated via another actuation system to supply additional lift force to the tubing string. The combined lift force from the boost cylinder(s) and the jack's built-in hydraulic cylinders can be significantly greater than (e.g., double) the lift force supplied by the jack's built-in hydraulic cylinders alone.

In some examples, the modular boost system can provide a physically smaller, cheaper, more flexible, and lower-weight solution than alternative approaches to increasing lift capabilities at a wellsite, such as using higher-rated jacks, which can be physically larger, more expensive, less flexible, and heavy. Additionally, the modular boost systems can be easily shared among well operators and well sites, reducing the total cost of ownership for the modular boost system. In some examples, the modular boost system may reduce the need for different sized jacks, enabling greater standardization of jacks and jack components.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a perspective view of an example of a well system 100 according to some aspects. The well system 100 includes a wellbore 104 drilled through a subterranean formation 106. A blowout prevention (BOP) stack 110 is positioned at the well surface 102 for controlling pressure in the wellbore 104. In this example, a jack 112 is coupled to the BOP stack 110. In some examples, the jack 112 can be used to perform tripping. Tripping can involve pulling a well tool (e.g., a tubing string) out of the wellbore 104 or replace the well tool in the wellbore. A work basket 114 can be coupled to the jack 112 to enable well operators to control operation of the jack 112 or other well tools. Although this example shows a well system 100 positioned onshore, in other examples the well system can be positioned offshore and the wellbore can extend into a seabed at the bottom of the ocean.

Figure 2:
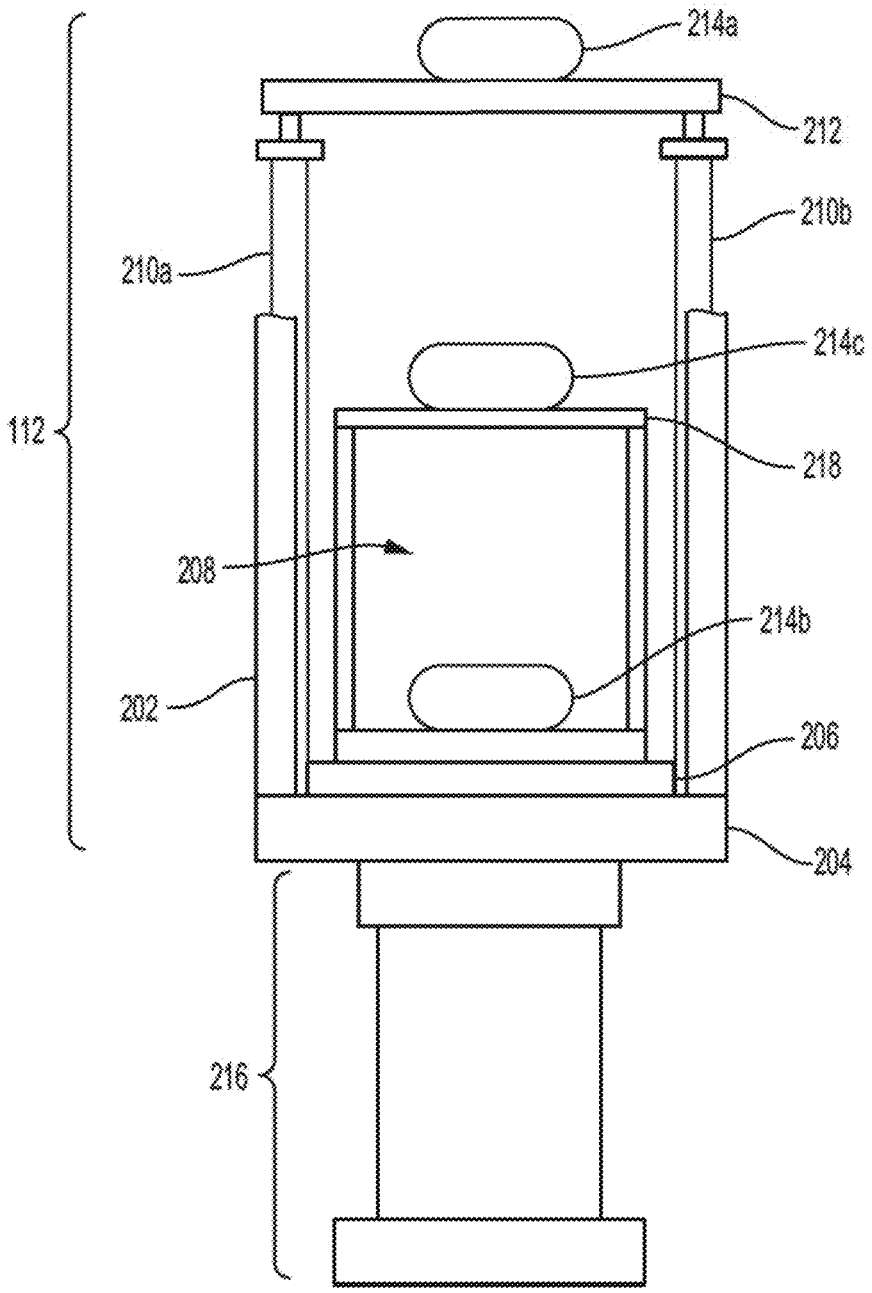
FIG. 2 is a cross-sectional side view of an example of a jack according to some aspects.

One example of the jack 112 is shown in FIG. 2. The jack 112 includes a frame 202 formed from any suitable material(s), such as metal. The frame 202 can include one or more vertical members that define a perimeter of the frame 202. A base plate 204 can form a base of the frame. The base plate 204 can be formed from any suitable material(s), such as metal. The base plate 204 can be configured (e.g., sized, designed, manufactured, etc.) to handle the total load from the combination of the jack's built-in hydraulic cylinders and the modular boost system. For example, if the jack's built-in hydraulic cylinders are capable of supplying 250 thousand pounds (klb) of lift force and the modular boost system is capable of supplying an additional 250 klb of lift force, the base plate 204 can be configured to handle at least 500 klb of lift force. An adjustable plate 206 can be removably coupled to the base plate 204 of the jack 112. For example, the adjustable plate 206 can be selectively attached to a stationary location in the frame 202 (e.g., coupled to the base plate 204) or detached from the stationary location to enable the adjustable plate 206 to vertically move. The adjustable plate 206 can be removably coupled to the base plate 204 using any suitable device, such as bolts, pins, screws, clamps, fasteners, or any combination of these.

A window 208 can be included within the frame 202 of the jack 112 for providing accessibility to a well tool positioned through the jack 112. An example of the window 208 can be a stationary slip window. The window 208 can be at least partially defined by a platform 218 on top and the adjustable plate 206 on the bottom.

The jack 112 can also include one or more hydraulic cylinders, such as hydraulic cylinders 210*a-b*, that can longitudinally expand and retract in size to apply a vertical force to a movable plate 212 coupled to the hydraulic cylinder(s). This can enable the movable plate 212 to vertically move as the hydraulic cylinders expand and contract in size.

The jack 112 can include one or more coupling elements, such as coupling elements 214*a-c*. Examples of the coupling elements can be slip bowls, bolts, clamps, pinning mechanisms, or any combination of these. The coupling elements can removably couple the jack 112 to a well tool positioned through the jack 112. In the example shown in FIG. 2, one coupling element 214*a* is positioned on the movable plate 212 for selectively securing the movable plate 212 to the well tool. Another coupling element 214*b* is positioned in the jack 112 for selectively securing the adjustable plate 206 to the well tool. And another coupling element 214*c* is positioned in the jack 112 for selectively securing the platform 218 to the well tool. But the jack 112 can include any number and combination of coupling elements positioned on any number and combination of locations.

A spacing component 216 can be positioned beneath the jack 112 to provide sufficient height to add the modular boost system to the jack 112. Examples of the spacing component 216 a spool, bell nipple, tube, or any combination of these. In one example, the spacing component 216 can be positioned between the BOP stack 110 and the jack 112 of FIG. 1.

Figure 3:
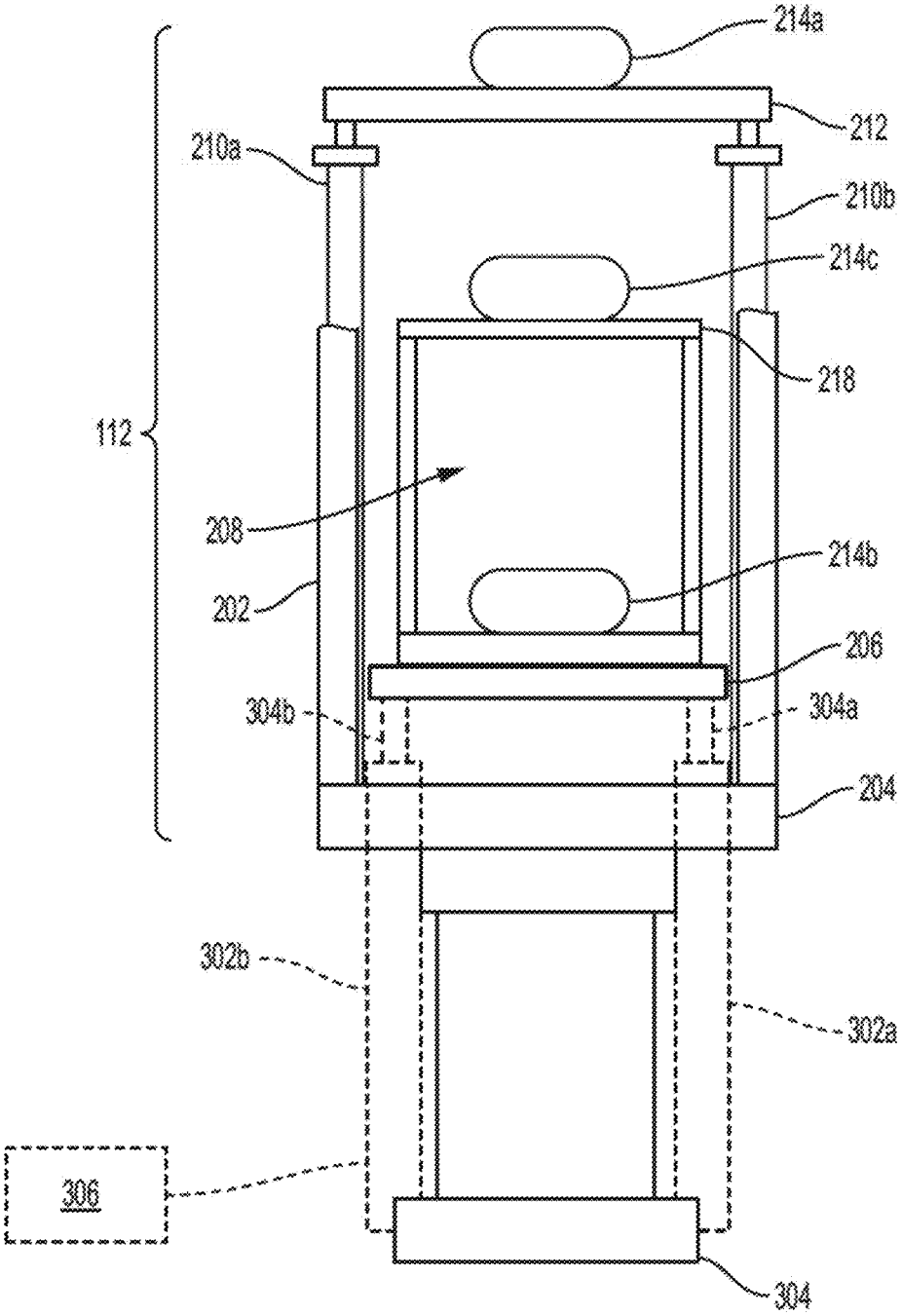
FIG. 3 is cross-sectional side view of an example of the jack of FIG. 2 with a modular boost system according to some aspects.

During well operations, it may become desirable to increase the lift capabilities of the jack 112. So, in some examples, a modular boost system can be added to the jack 112. One example of the jack 112 with the modular boost system is shown in FIG. 3. The modular boost system is at least partially shown by the boost cylinders 302*a-b* depicted using dashed lines. Although two boost-cylinders 302*a-b* are shown in FIG. 3, the modular boost system can include any number and combination of boost cylinders.

Figure 4:
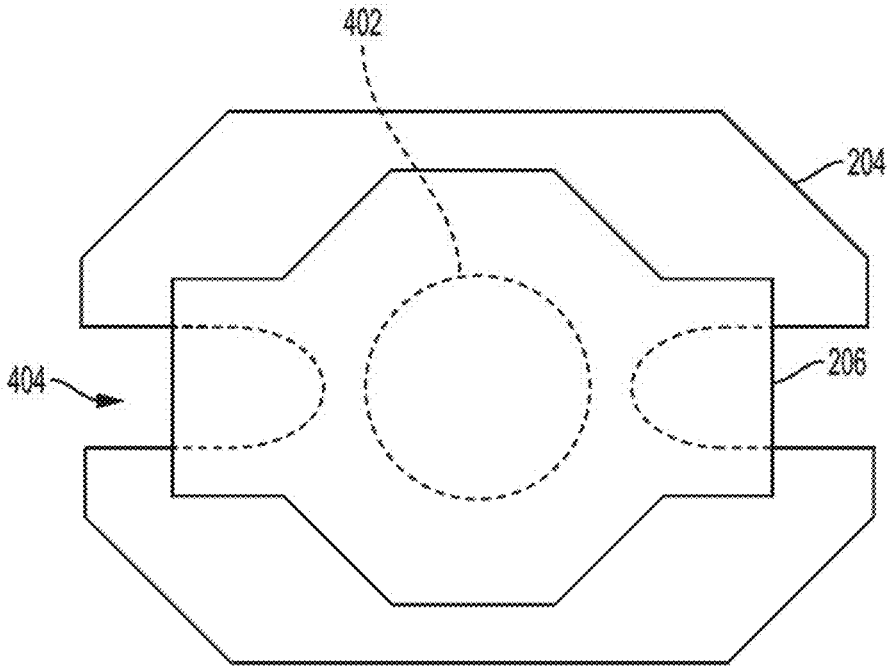
FIG. 4 is a top view of an example of plates in the jack of FIG. 3 according to some aspects.
Figure 5:
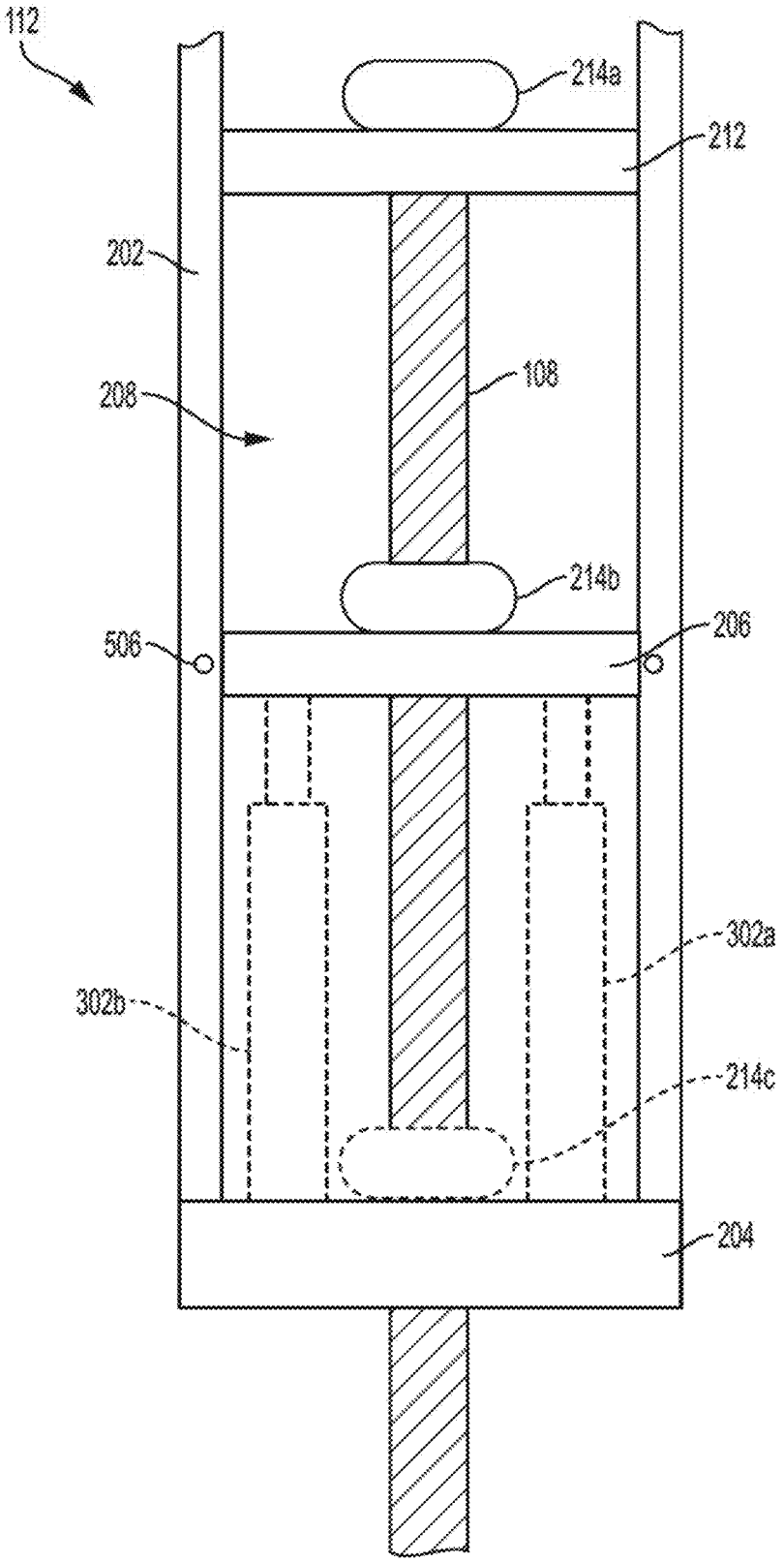
FIG. 5 is a cross-sectional side view of another example of a jack with a modular boost system according to some aspects.

To attach the boost cylinders 302*a-b* to the jack 112, one end of the boost cylinders 302*a-b* can be removably coupled to the adjustable plate 206. Another end of the boost cylinders 302*a-b* can be removably coupled to a base, such as base plate 204 of the jack 112 or a portion 304 of the spacing component 216. In an example in which the other end of the boost cylinders 302*a-b* is coupled to the spacing component 216, the boost cylinders 302*a-b* can be at least partially installed through the base plate 204 of the jack 112. This can be effectuated by openings in the base plate 204 of the jack. For example, as shown in the top-down view of FIG. 4, the base plate 204 can include openings 404 on each side for enabling the boost cylinders 302*a-b* to be at least partially installed through the base plate 204. Examples of the openings 404 can include slots or gaps. The base plate 204 can also include an opening 402 through which the well tool 108 can be positioned (e.g., as shown in FIG. 5) in the jack 112. The base plate 204 can include any number and combination of openings.

Referring back to FIG. 3, the boost cylinders 302*a-b* can each include respective rods 304*a-b* that can provide telescoping functionality to the boost cylinders 302*a-b* to enable the boost cylinders 302*a-b* to longitudinally expand and contract it size. The boost cylinders 302*a-b* can be hydraulically or electrically operated using an actuation system 306 (e.g., a hydraulic actuation system), which may or may not be considered part of the modular boost system. This actuation system 306 can be separate from another actuation system used to control the built-in hydraulic cylinders of the jack 112.

FIG. 5 is a cross-sectional side view of another example of a jack 112 with a modular boost system according to some aspects. The jack 112 can be used to apply a force on a well tool 108 at least partially positioned through the jack 112. The jack 112 includes a base plate 204, a movable plate 212, and an adjustable plate 206 within a frame 202.

The adjustable plate 206 can be removably coupled to the frame 202 of the jack 112. For example, the frame 202 can have one or more sets of pinholes 506 along vertical members of the frame 202 to enable the adjustable plate 206 to be pinned at a particular location in the frame 202. This can fix the adjustable plate 206 at a stationary location in the frame 202. The pins can be selectively removed to detach the adjustable plate 206 from the stationary location in the frame 202 and thereby enable the adjustable plate 206 to vertically move within the frame 202. In other examples, the adjustable plate 206 can be removably coupled to the frame 202 using other devices, such as bolts, clips, fasteners, or any combination of these.

The modular boost system can include one or more boost cylinders, such as boost cylinders 302*a-b* shown in dashed lines. The boost cylinders 302*a-b* can be mounted between the adjustable plate 206 and a base, such as base plate 204, for applying a force to the adjustable plate 206. When the adjustable plate 206 is decoupled from the frame 202, the force supplied by the boost cylinders 302*a-b* can vertically move the adjustable plate 206.

In some examples, the modular boost system can include another coupling element 214*c* that can be removably coupled to the base plate 204. This coupling element 214 can enable the well tool 108 to be selectively attached to the base plate 204, as discussed in greater detail below. The coupling element 214*c* can be configured to handle the total load produced by a combination of the boost cylinders 302*a-b* and the built-in hydraulic cylinder(s) of the jack 112.

Figure 6:
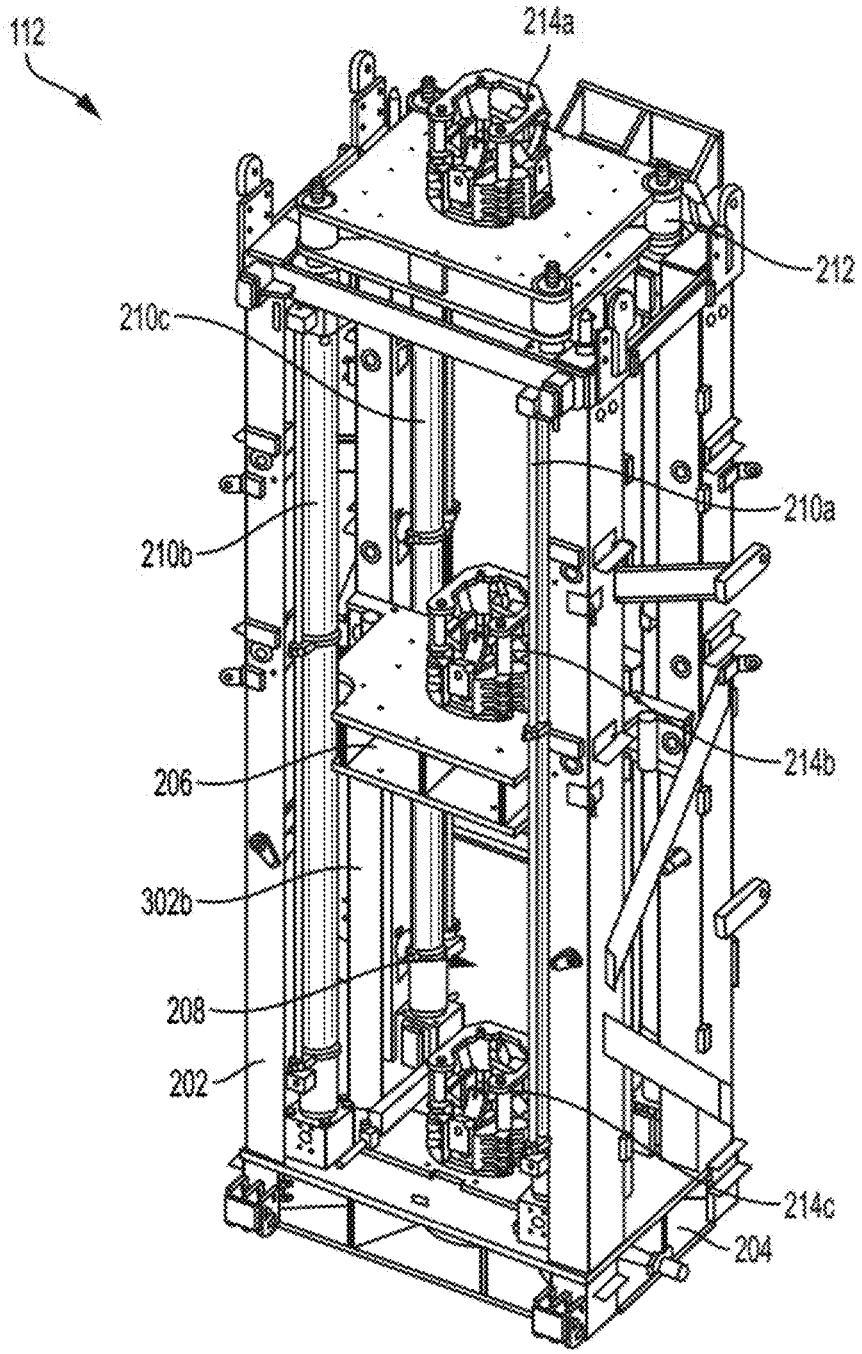
FIG. 6 is a perspective view of an example of the jack of FIG. 5 in a retracted configuration and with the modular boost system according to some aspects.

FIG. 6 is a perspective view of an example of the jack 112 of FIG. 5 in a retracted configuration and with the modular boost system according to some aspects. As shown, the jack 112 includes a base plate 204 having a coupling element 214*c*, an adjustable plate 206 having a coupling element

Figure 7:
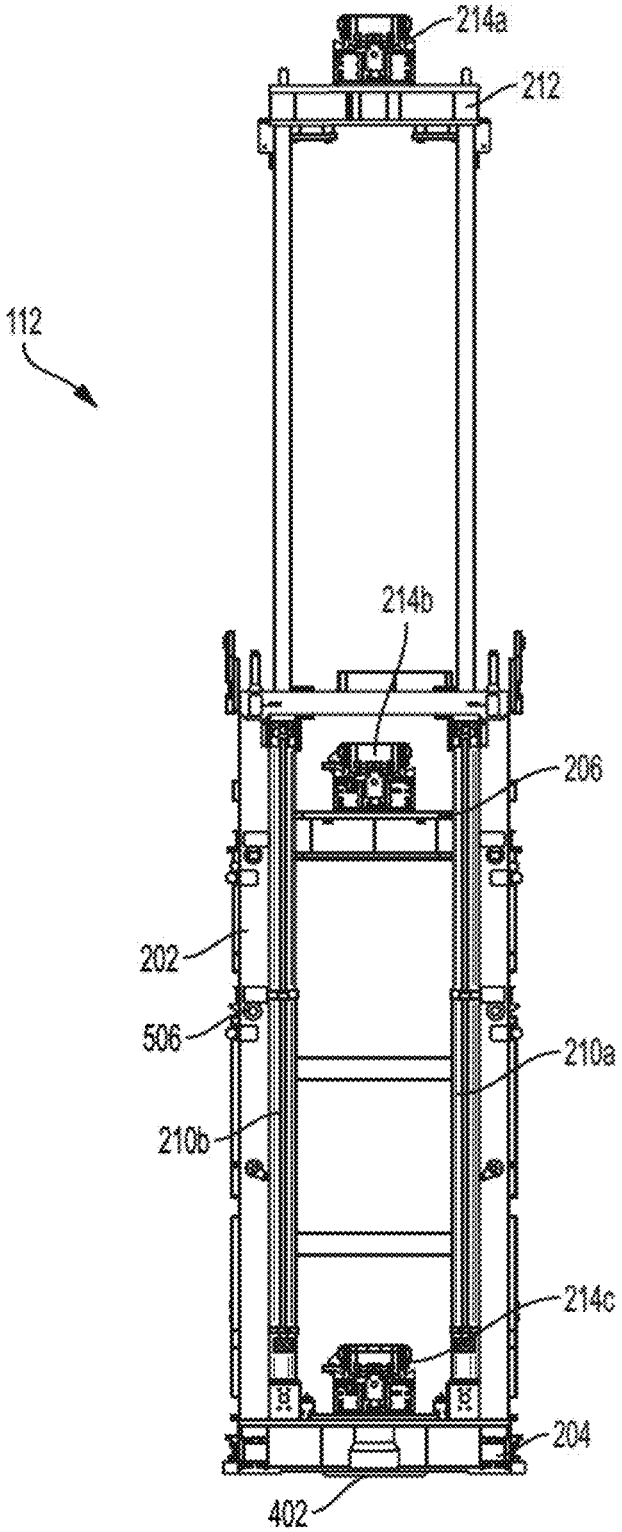
FIG. 7 is a side view of an example of the jack of FIG. 6 in an expanded configuration according to some aspects.

214*b*, and a movable plate 212 having a coupling element 214*a*. The base plate 204 forms a base of the frame 202 of the jack 112. Built-in hydraulic cylinders (e.g., hydraulic cylinders 210*a-c*) are coupled between the base plate 204 and the movable plate 212 for lifting the movable plate 212 away from the base plate 204, for example, as shown in FIG. 7. Returning to FIG. 6, the jack 112 can also include a modular boost system that includes at least one boost cylinder, such as boost cylinder 302*b*. The boost cylinder(s) can be coupled between the adjustable plate 206 and a base, such as base plate 204, for supplying additional lift capabilities to the jack 112 beyond the lift capabilities supplied by the built-in hydraulic cylinders 210*a-c*. The boost cylinders can be installed through a window 208 (e.g., a work window) in the jack 112 that enables access to an area between the base plate 204 and the adjustable plate 206.

Figure 8:
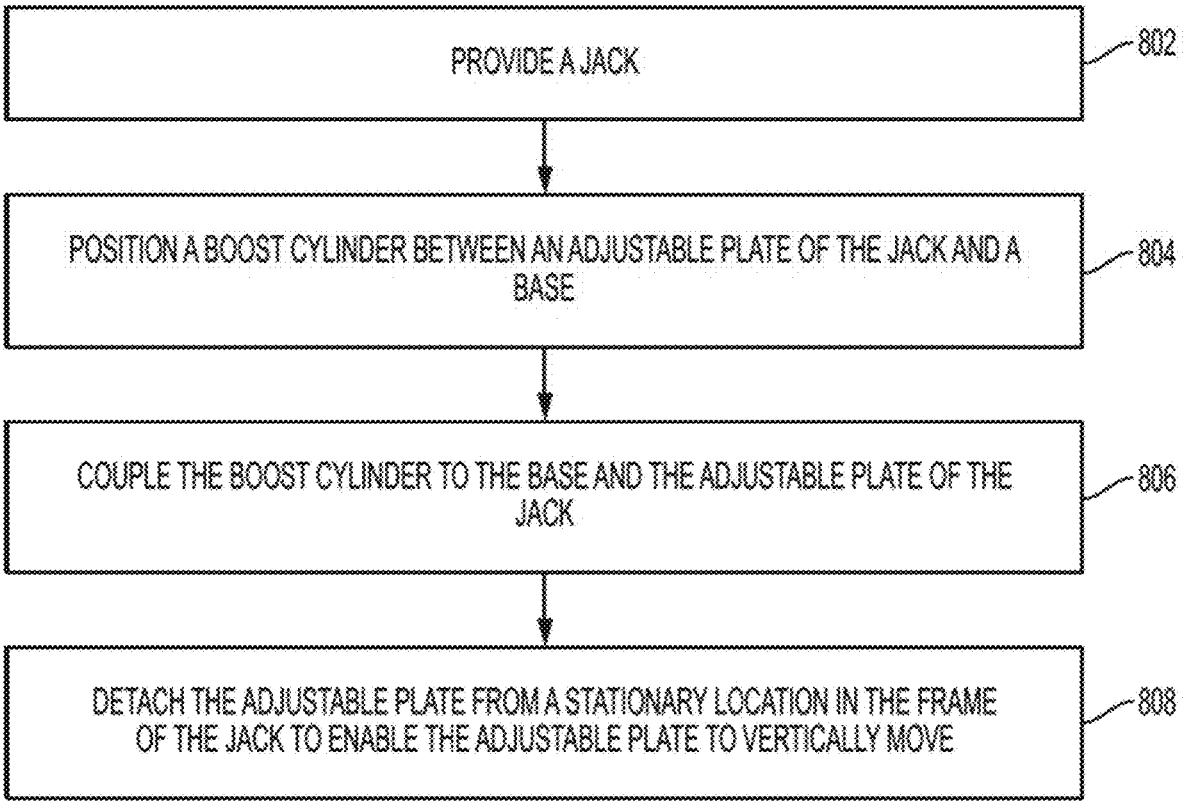
FIG. 8 is a flow chart of an example of a process for installing a modular boost system on a jack according to some aspects.

FIG. 8 is a flow chart of an example of a process for installing a modular boost system on a jack according to some aspects. Some examples can include more steps, fewer steps, different steps, or a different order of the steps than depicted in FIG. 8. The steps below will be described with reference to the components discussed above.

In block 802, a jack 112 is provided. The jack 112 can be provided by a manufacturer, distributor, well operator, or any combination of these. The jack 112 can be provided at a well site or another part of a well system 100. The jack 112 can be provided as an integral unit, without a modular boost system.

The jack 112 can have built-in hydraulic cylinders for moving a movable plate 212 toward or away from a base plate 204 in a frame 202 of the jack 112. In some examples, these hydraulic cylinders may have an insufficient lift capability to perform a well operation. So, a well operator may wish to install a modular boost system into the jack 112 to increase the lift capabilities of the jack 112.

In block 804, a boost cylinder 302 is positioned between an adjustable plate 206 of the jack 112 and a base. The base can include the base plate 204, a portion of a spacing component 216 (e.g., portion 304), or another component.

In some examples, the boost cylinder 302 can be positioned through an opening 404 in the base plate 204 and/or another plate of the jack 112 to couple the boost cylinder 302 to the jack 112. Additionally or alternatively, the adjustable plate 206 may need to be lifted up before the boost cylinder 302 can fit between the adjustable plate 206 and the base. In one such example, the adjustable plate 206 can be moved and fixed at a stationary location in the frame 202, where the stationary location is at a distance from the base that is greater than or equal to a length of the boost cylinder 302. This may enable the boost cylinder 302 to fit between the adjustable plate 206 and the base.

In some examples, steps 804-806 can be repeated for multiple boost cylinders, such as boost cylinders 302*a-b*, if the modular boost system is to have more than one boost cylinder.

In block 806, the boost cylinder 302 is coupled (e.g., removably coupled) to the base and the adjustable plate 206 of the jack. The boost cylinder 302 can be coupled to the base and the adjustable plate 206 using one or more attachment elements, such as bolts, screws, pins, latches, clamps, or any combination of these. The attachment elements can be selectively removable for subsequently removing the modular boost system, if desired.

In block 808, the adjustable plate 206 is detached from a stationary location in the frame 202 of the jack 112 to enable the adjustable plate 206 to vertically move. For example, the adjustable plate 206 can be unbolted, unscrewed, unpinned, or any combination of these, from the frame 202. This can enable the adjustable plate 206 to be vertically moved by the boost cylinder 302.

In some examples, the modular boost system can be removed from the jack 112 by performing the steps of FIG. 8 in reverse order. For example, the adjustable plate 206 can be re-attached to a stationary location in the frame 202. Then, the boost cylinder 302 can then be decoupled from the adjustable plate 206 and the base. Finally, the boost cylinder 302 can be removed from the jack 112.

Figure 9:
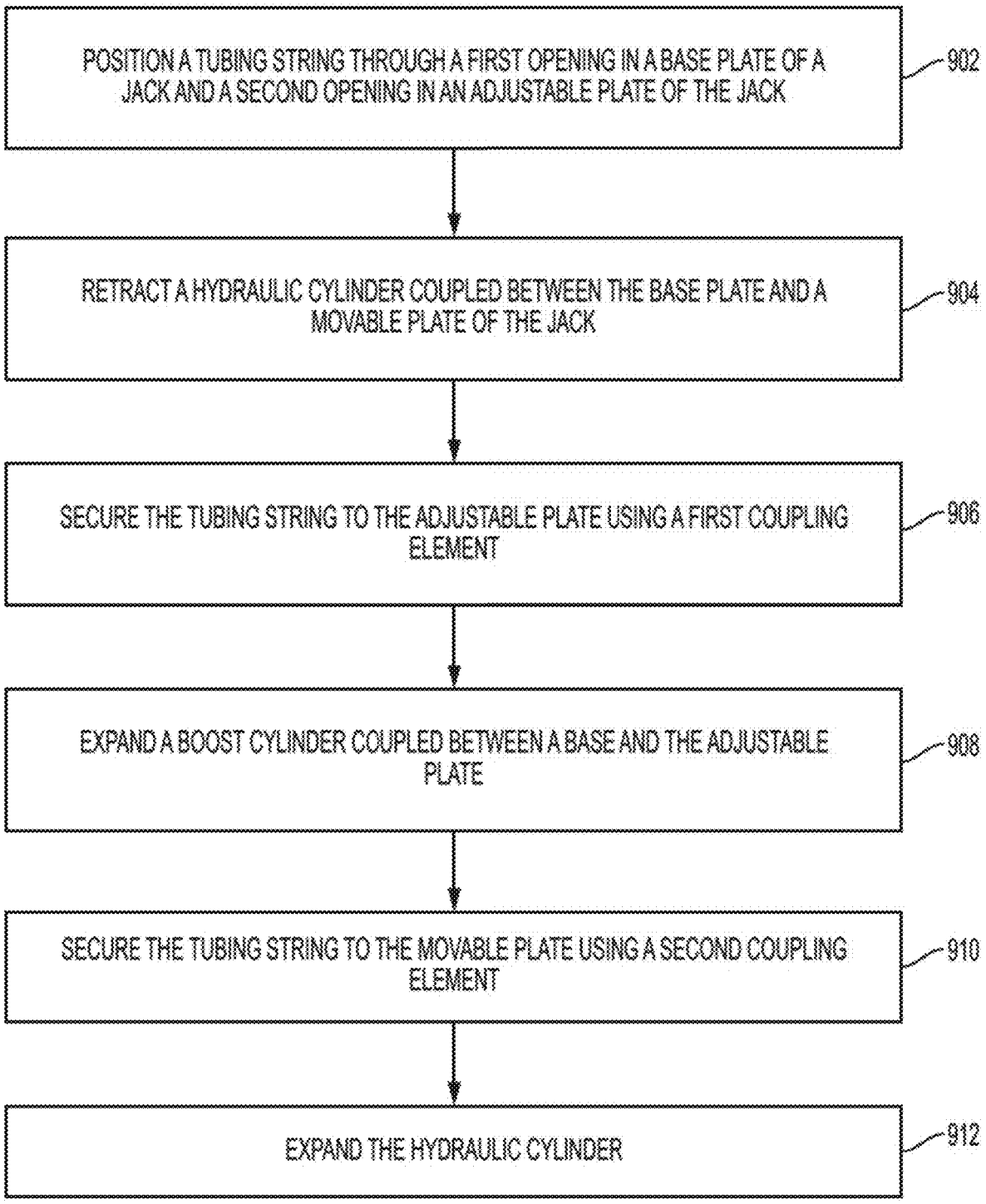
FIG. 9 is a flow chart of an example of a process for using a modular boost system on a jack according to some aspects.

FIG. 9 is a flow chart of an example of a process for using a modular boost system on a jack according to some aspects. Some examples can include more steps, fewer steps, different steps, or a different order of the steps than depicted in FIG. 9. Although the steps in FIG. 9 are described with respect to a tubing string, in other examples other types of well tools can be used. The steps below will be described with reference to the components discussed above.

In block 902, a tubing string is positioned through a first opening in a base plate 204 of a jack 112 and a second opening in an adjustable plate 206 of the jack 112. The first opening and second opening can be sized to receive the tubing string.

In block 904, one or more hydraulic cylinders 210 are retracted to a retracted position (e.g., a fully retracted position). The hydraulic cylinder(s) 210 can be coupled between the base plate 204 and a movable plate 212 of the jack 112.

In block 906, the tubing string is secured to the adjustable plate 206 via a first coupling element 214*b*, such as a slip bowl. The first coupling element 214*b* can be fixed to the adjustable plate 206.

In block 908, a boost cylinder 302 is expanded to an expanded position (e.g., a fully expanded position). This can apply a lift force to the tubing string. The boost cylinder 302 can be expanded by supplying electrical or hydraulic power to the boost cylinder 302 via a first actuation system, such as a first hydraulic-actuation system. The lift force capable of being supplied by the boost cylinder 302 may be higher or lower than the lift force capable of being supplied by the one or more hydraulic cylinders 210.

In block 910, the tubing string can be secured to the movable plate 212 using a second coupling element 214*a*, such as a slip bowl. The second coupling element 214*a* can be fixed to the movable plate 212. The tubing string may also be unsecured from the adjustable plate 206 by disengaging the first coupling element 214*b* (e.g., subsequent to the tubing string being secured to the movable plate 212).

In block 912, the one or more hydraulic cylinders 210 can be expanded to an expanded position (e.g., to a fully expanded position). This can apply an additional lift force to the tubing string. The hydraulic cylinders 210 can be expanded by supplying hydraulic power to the hydraulic cylinders 210 via a second actuation system, such as a second hydraulic-actuation system. The second actuation system may or may not be separate from the first actuation system used to power the boost cylinder 302. In some examples, the hydraulic actuation system used to control the one or more hydraulic cylinders 210 can be more fine-grained than the actuation system used to control the boost cylinder 302 for more finely tuning the vertical lift applied to the tubing string.

In some examples, steps 904-912 can be referred to as a stroke. It may take multiple strokes to dislodge, extract, or otherwise move the tubing string by a desired amount. So, upon the completion of a stroke, a well operator can reset the system in some examples by securing the tubing string to a third coupling element 214*c* fixed to the base plate 204. This can hold the tubing string in position. While the tubing string is held in position by the third coupling element 214*c*, the first coupling element 214*b* and second coupling element 214*a* can be disengaged. After disengaging the coupling elements 214*a-b*, the boost cylinders 302 can be retracted into a retracted position, such as a fully retracted position. The process can then be repeated (e.g., starting at block 904) to perform another stroke.

In some examples, it may be desirable to remove slack from the tubing string, for example, prior to performing steps 906-912. In one such example, after positioning the tubing string in the jack in block 902, slack in the tubing string can be reduced by first securing the tubing string to the movable plate 212. Then, the one or more hydraulic cylinders 210 can be expanded into an expanded position in which slack in the tubing string is reduced. The tubing string can then be secured to the base via the third coupling element 214*c*. This can hold the tubing string in position. Next, the tubing string can be unsecured from the movable plate 212 by disengaging the second coupling element 214*a*. Finally, the at least one hydraulic cylinders 210 can be retracted to lower the movable plate around the tubing string. At this point, slack in the tubing string has been reduced or eliminated, and the method can then continue at block 906. The above series of steps is illustrative, and more steps, fewer steps, or a different order of the steps discussed above can be employed to reduce slack in the tubing string in some examples.

In some aspects, a modular boost system for a jack is provided according to one or more of the following examples:

Example #1

A system can include a jack that is positionable at a well surface for moving a tubing string through a wellbore in a subterranean formation. The jack can include a frame and an adjustable plate that is alternately (i) attachable at a stationary location in the frame for fixing the adjustable plate at the stationary location and (ii) detachable from the stationary location in the frame to enable the adjustable plate to vertically move within the frame. The system can include a boost cylinder that is removably couplable between the adjustable plate and a base for selectively supplying an additional lift capability to the jack.

Example #2

The system of Example #1 may feature the jack including a movable plate having a first coupling element for selectively securing the movable plate to the tubing string. The jack can include the adjustable plate having a second coupling element for selectively securing the adjustable plate to the tubing string. The adjustable plate can be positioned between the movable plate and the base. The jack can include at least one hydraulic cylinder coupled between the movable plate and a base plate of the jack for applying vertical force to the movable plate to move the tubing string through the wellbore. The at least one hydraulic cylinder can be separate from the boost cylinder.

Example #3

The system of any of Examples #1-2 may feature the base being the base plate of the jack. The system can have the boost cylinder being coupled between the adjustable plate and the base plate of the jack for supplying the additional lift capability to the jack. The system can have a hydraulic actuation system that is coupled to the boost cylinder for controlling operation of the boost cylinder.

Example #4

The system of any of Examples #2-3 may feature a third coupling element that is attached to the base plate for selectively securing the base plate to the tubing string. The third coupling element can be rated for handling a total load produced by a combination of the boost cylinder and the at least one hydraulic cylinder.

Example #5

The system of Example #4 may feature the first coupling element being a first slip bowl, the second coupling element being a second slip bowl, and the third coupling element being a third slip bowl.

Example #6

The system of any of Examples #2 and 4-5 may feature the base being a portion of a spacing element. The base plate can have an opening for enabling the boost cylinder to be at least partially installed through the base plate to couple the boost cylinder to the jack.

Example #7

A method for installing a boost cylinder in a jack can include providing a jack having a frame, an adjustable plate, and at least one hydraulic cylinder that is separate from the boost cylinder. The method can include positioning the boost cylinder between a base and the adjustable plate of the jack. The method can include coupling the boost cylinder to the base and the adjustable plate of the jack. The method can include detaching the adjustable plate from a stationary location in the frame of the jack to enable the adjustable plate to vertically move in response to vertical force supplied by the boost cylinder.

Example #8

The method of Example #7 may feature the jack being a hydraulic workover jack usable for moving a tubing string through a wellbore in a subterranean formation.

Example #9

The method of any of Examples #7-8 may feature the jack including a moveable plate. The jack can have the adjustable plate positioned between the movable plate and the base. The jack can have the at least one hydraulic cylinder coupled between a base plate and the movable plate for applying vertical force to the movable plate to move the tubing string through the wellbore.

Example #10

The method of any of Examples #7-9 may include, prior to positioning the boost cylinder between the base and the adjustable plate of the jack, fixing the adjustable plate at the stationary location in the frame. The stationary location can be at a distance from the base that is greater than or equal to a length of the boost cylinder.

Example #11

The method of any of Examples #7-10 may include fixing the adjustable plate at a stationary location in the frame by pinning the adjustable plate at the stationary location in the frame. Detaching the adjustable plate from the stationary location in the frame can include unpinning the adjustable plate from the stationary location in the frame.

Example #12

The method of any of Examples #7-11 may include coupling a first hydraulic actuation system to the boost cylinder for controlling operation of the boost cylinder. The first hydraulic actuation system can be separate from a second hydraulic actuation system coupled to the at least one hydraulic cylinder for controlling operation of the at least one hydraulic cylinder.

Example #13

The method of any of Examples #7-12 may include positioning the boost cylinder between the base and the adjustable plate by positioning the boost cylinder through an opening in a base plate in the jack. The base can be separate from the base plate in the jack.

Example #14

A method of using a jack with a modular boost system to move a tubing string in a wellbore can include positioning the tubing string through a first opening in a base plate of a frame of the jack and a second opening in an adjustable plate of the jack. The method can include retracting at least one hydraulic cylinder coupled between the base plate and a movable plate of the jack to a retracted position. The method can include securing the tubing string to the adjustable plate via a first coupling element fixed to the adjustable plate. The method can include expanding boost cylinder coupled between a base and the adjustable plate to a first expanded position. The boost cylinder can be part of the modular boost system and separate from the at least one hydraulic cylinder. The method can include securing the tubing string to the movable plate via a second coupling element fixed to the movable plate. The method can include expanding the at least one hydraulic cylinder to a second expanded position to move the tubing string through the wellbore.

Example #15

The method of Example #14 may feature the retracted position being a first retracted position, and retracting the at least one hydraulic cylinder to the first retracted position can involve reducing slack in the tubing string. The slack in the tubing string can be reduced by securing the tubing string to the movable plate via the second coupling element. The at least one hydraulic cylinder can be expanded to a third expanded position in which the slack in the tubing string is reduced. The tubing string can be secured to the base via a third coupling element fixed to the base to hold the tubing string in position. The tubing string can be unsecured from the movable plate by disengaging the second coupling element. The at least one hydraulic cylinder can be retracted to the first retracted position to lower the movable plate around the tubing string.

Example #16

The method of any of Examples #14-15 can include expanding the boost cylinder using a first hydraulic-actuation system that forms part of the modular boost system. The method can include expanding the at least one hydraulic cylinder using a second hydraulic-actuation system that is separate from the first hydraulic-actuation system.

Example #17

The method of any of Examples #14-16 can include installing the modular boost system in the jack subsequent to the jack being positioned at a wellsite associated with the wellbore.

Example #18

The method of any of Examples #14-17 may feature moving the tubing string in the wellbore at least partially including releasing a portion of the tubing string stuck in the wellbore.

Example #19

The method of any of Examples #14-18 can include removing the modular boost system from the jack after releasing a portion of the tubing string stuck in the wellbore.

Example #20

The method of any of Examples #14-19 may include, prior expanding the at least one hydraulic cylinder to the second expanded position, unsecuring the tubing string from the adjustable plate by disengaging the first coupling element.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

The invention claimed is:

1. A system comprising:

a jack positionable at a well surface for moving a tubing string through a wellbore in a subterranean formation, the jack comprising:

a frame;

a movable plate having a first coupling element for selectively securing the movable plate to the tubing string;

an adjustable plate that is alternately (i) attachable at a stationary location in the frame for fixing the adjustable plate at the stationary location and (ii) detachable from the stationary location in the frame to enable the adjustable plate to vertically move within the frame, wherein the adjustable plate has a second coupling element for selectively securing the adjustable plate to the tubing string, and wherein the adjustable plate is positioned between the movable plate and a base; and at least one hydraulic cylinder coupled between the movable plate and a base plate of the jack for applying vertical force to the movable plate to move the tubing string through the wellbore; and a boost cylinder removably couplable between the adjustable plate and the base for selectively supplying an additional lift capability to the jack, the boost cylinder being separate from the at least one hydraulic cylinder.

2. The system of claim 1, wherein:

the base is the base plate of the jack;

the boost cylinder is coupled between the adjustable plate and the base plate of the jack for supplying the additional lift capability to the jack; and a hydraulic actuation system is coupled to the boost cylinder for controlling operation of the boost cylinder.

3. The system of claim 2, wherein a third coupling element is attached to the base plate for selectively securing the base plate to the tubing string, the third coupling element being rated for handling a total load produced by a combination of the boost cylinder and the at least one hydraulic cylinder.

4. The system of claim 3, wherein the first coupling element is a first slip bowl, the second coupling element is a second slip bowl, and the third coupling element is a third slip bowl.

5. The system of claim 1, wherein:

the base is a portion of a spacing element; and the base plate has an opening for enabling the boost cylinder to be at least partially installed through the base plate to couple the boost cylinder to the jack.

6. A method for installing a boost cylinder in a jack, the method comprising:

providing a jack having a frame, a movable plate, an adjustable plate positioned between the movable plate and a base, and at least one hydraulic cylinder that is separate from the boost cylinder and that is coupled between a base plate and the movable plate for applying vertical force to the movable plate to move a tubing string through a wellbore;

positioning the boost cylinder between the base and the adjustable plate of the jack;

coupling the boost cylinder to the base and the adjustable plate of the jack; and detaching the adjustable plate from a stationary location in the frame of the jack to enable the adjustable plate to vertically move in response to vertical force supplied by the boost cylinder.

7. The method of claim 6, wherein the jack is a hydraulic workover jack usable for moving the tubing string through the wellbore in a subterranean formation.

8. The method of claim 6, further comprising, prior to positioning the boost cylinder between the base and the adjustable plate of the jack:

fixing the adjustable plate at the stationary location in the frame, the stationary location being at a distance from the base that is greater than or equal to a length of the boost cylinder.

9. The method of claim 8, wherein fixing the adjustable plate at the stationary location in the frame comprises pinning the adjustable plate at the stationary location in the frame, and wherein detaching the adjustable plate from the stationary location in the frame comprising unpinning the adjustable plate from the stationary location in the frame.

10. The method of claim 6, further comprising coupling a first hydraulic actuation system to the boost cylinder for controlling operation of the boost cylinder, the first hydraulic actuation system being separate from a second hydraulic actuation system coupled to the at least one hydraulic cylinder for controlling operation of the at least one hydraulic cylinder.

11. The method of claim 6, wherein positioning the boost cylinder between the base and the adjustable plate comprises positioning the boost cylinder through an opening in the base plate in the jack, the base being separate from the base plate in the jack.

12. A method of using a jack with a modular boost system to move a tubing string in a wellbore, the method comprising:

positioning the tubing string through a first opening in a base plate of a frame of the jack and a second opening in an adjustable plate of the jack;

retracting at least one hydraulic cylinder coupled between the base plate and a movable plate of the jack to a retracted position;

securing the tubing string to the adjustable plate via a first coupling element fixed to the adjustable plate;

expanding a boost cylinder coupled between a base and the adjustable plate to a first expanded position, wherein the boost cylinder is part of the modular boost system and separate from the at least one hydraulic cylinder;

securing the tubing string to the movable plate via a second coupling element fixed to the movable plate; and expanding the at least one hydraulic cylinder to a second expanded position to move the tubing string through the wellbore.

13. The method of claim 12, wherein the retracted position is a first retracted position, and wherein retracting the at least one hydraulic cylinder to the first retracted position involves reducing slack in the tubing string by:

securing the tubing string to the movable plate via the second coupling element;

expanding the at least one hydraulic cylinder to a third expanded position in which the slack in the tubing string is reduced;

securing the tubing string to the base via a third coupling element fixed to the base to hold the tubing string in position;

unsecuring the tubing string from the movable plate by disengaging the second coupling element; and retracting the at least one hydraulic cylinder to the first retracted position to lower the movable plate around the tubing string.

14. The method of claim 12, further comprising:

expanding the boost cylinder using a first hydraulic-actuation system that forms part of the modular boost system; and expanding the at least one hydraulic cylinder using a second hydraulic-actuation system that is separate from the first hydraulic-actuation system.

15. The method of claim 12, further comprising installing the modular boost system in the jack subsequent to the jack being positioned at a wellsite associated with the wellbore.

16. The method of claim 12, wherein moving the tubing string in the wellbore at least partially comprises releasing a portion of the tubing string stuck in the wellbore.

17. The method of claim 16, further comprising removing the modular boost system from the jack after releasing the portion of the tubing string stuck in the wellbore.

18. The method of claim 12, further comprising, prior expanding the at least one hydraulic cylinder to the second expanded position, unsecuring the tubing string from the adjustable plate by disengaging the first coupling element.

* * * * *